US009743811B1

(12) United States Patent
Giumarra et al.

(10) Patent No.: US 9,743,811 B1
(45) Date of Patent: Aug. 29, 2017

(54) SHOWER CURTAIN ASSEMBLY

(71) Applicants: Anthony Giumarra, New City, NY (US); Jody Rose Cioppa, Bronx, NY (US)

(72) Inventors: Anthony Giumarra, New City, NY (US); Jody Rose Cioppa, Bronx, NY (US)

( * ) Notice: Subject to any disclaimer, the term of this patent is extended or adjusted under 35 U.S.C. 154(b) by 0 days.

(21) Appl. No.: 15/153,814

(22) Filed: May 13, 2016

(51) Int. Cl.

| | |
|---|---|
| ***A47K 3/00*** | (2006.01) |
| ***A47K 3/38*** | (2006.01) |
| ***A47H 1/18*** | (2006.01) |
| ***A47H 13/02*** | (2006.01) |
| ***A47H 23/00*** | (2006.01) |

(52) U.S. Cl.
CPC ..... *A47K 3/38* (2013.01); *A47H 1/18* (2013.01); *A47H 13/02* (2013.01); *A47H 23/00* (2013.01)

(58) Field of Classification Search
CPC ..... A47K 3/38
USPC ..... 4/596–614
See application file for complete search history.

(56) References Cited

U.S. PATENT DOCUMENTS

| | | | | | |
|---|---|---|---|---|---|
| 1,979,674 | A * | 11/1934 | Cowan | A47H 13/04 | 16/87.2 |
| 4,120,343 | A * | 10/1978 | Wilson | A47K 3/38 | 160/330 |
| 5,231,708 | A * | 8/1993 | Hansen | A47K 3/38 | 160/263 |
| 5,495,628 | A * | 3/1996 | Logan | A47K 3/38 | 160/330 |
| 5,894,642 | A * | 4/1999 | Eberhardt | A47H 13/16 | 160/124 |
| 6,192,965 | B1 * | 2/2001 | Hinds | A47H 23/00 | 160/123 |
| 6,394,168 | B1 * | 5/2002 | Zoboski | A47H 13/00 | 160/123 |
| 7,523,778 | B2 * | 4/2009 | Roberts | A47H 23/08 | 160/237 |
| 7,600,274 | B2 * | 10/2009 | Washington | A47K 3/38 | 160/124 |
| 8,122,531 | B2 * | 2/2012 | Li | A47K 3/38 | 160/349.1 |
| 8,127,379 | B2 * | 3/2012 | Hardee | A44B 18/0046 | 160/368.1 |
| D671,782 | S * | 12/2012 | Braimah | A47K 3/38 | D6/575 |
| 8,826,471 | B1 | 9/2014 | Maddox | | |
| 9,204,749 | B1 * | 12/2015 | Trapani | A61G 12/00 | |
| 9,260,913 | B2 * | 2/2016 | Birkestrand | A61G 12/00 | |
| 2007/0256232 | A1 | 11/2007 | Erickson | | |
| 2007/0284058 | A1 * | 12/2007 | Peoples | A47H 2/00 | 160/123 |
| 2013/0283519 | A1 * | 10/2013 | Holden | A47H 23/00 | 4/558 |

FOREIGN PATENT DOCUMENTS

| | | |
|---|---|---|
| WO | WO9101108 | 2/1991 |

* cited by examiner

*Primary Examiner* — Lori Baker

(57) ABSTRACT

A shower curtain assembly includes a saddle that may be suspended from a shower rod. A plurality of curtains is provided and each of the curtains is removably coupled to the saddle. Thus, each of the curtains inhibits water from spraying outwardly from the shower. Each of the curtains is selectively removed from the saddle when each of the curtains becomes soiled. Thus, the plurality of curtains enhances cleanliness of the shower.

4 Claims, 4 Drawing Sheets

SHOWER CURTAIN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to curtain devices and more particularly pertains to a new curtain device having a plurality of removable curtains being selectively torn from a shower rod.

BRIEF SUMMARY OF THE INVENTION

An embodiment of the disclosure meets the needs presented above by generally comprising a saddle that may be suspended from a shower rod. A plurality of curtains is provided and each of the curtains is removably coupled to the saddle. Thus, each of the curtains inhibits water from spraying outwardly from the shower. Each of the curtains is selectively removed from the saddle when each of the curtains becomes soiled. Thus, the plurality of curtains enhances cleanliness of the shower.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
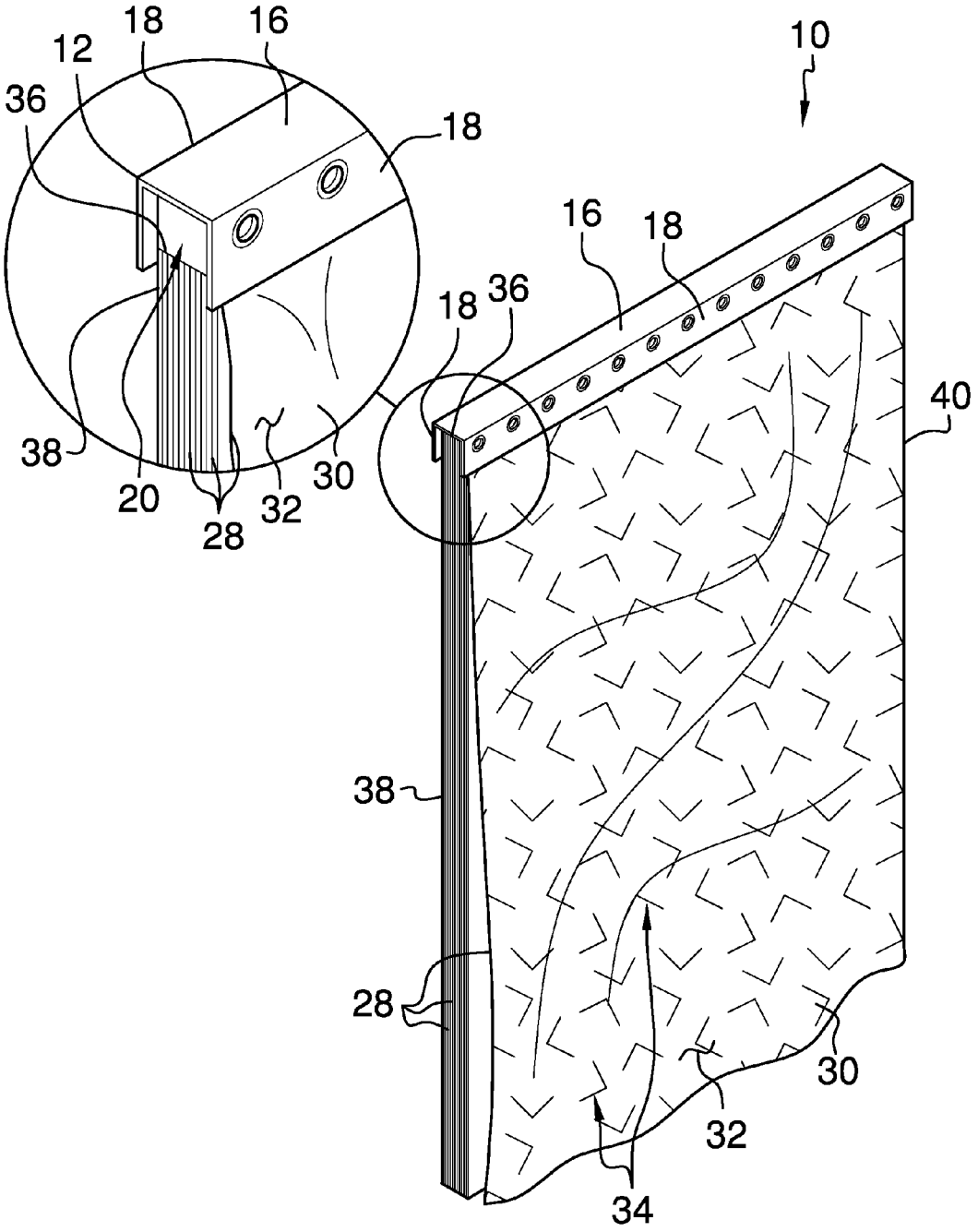
FIG. 1 is a front perspective view of a shower curtain assembly according to an embodiment of the disclosure.
Figure 2:
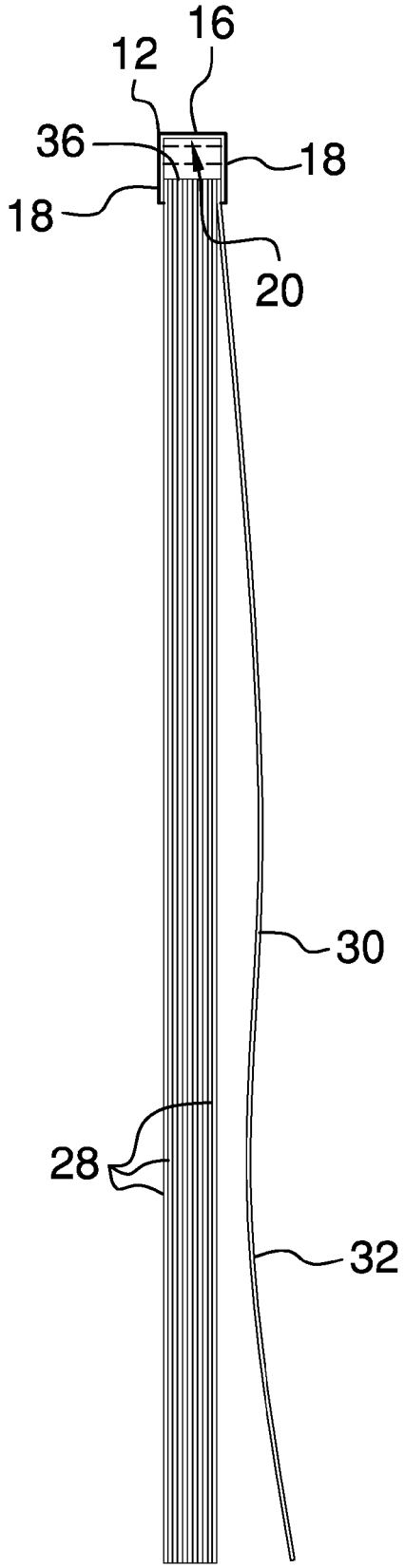
FIG. 2 is a right side view of an embodiment of the disclosure.
Figure 3:
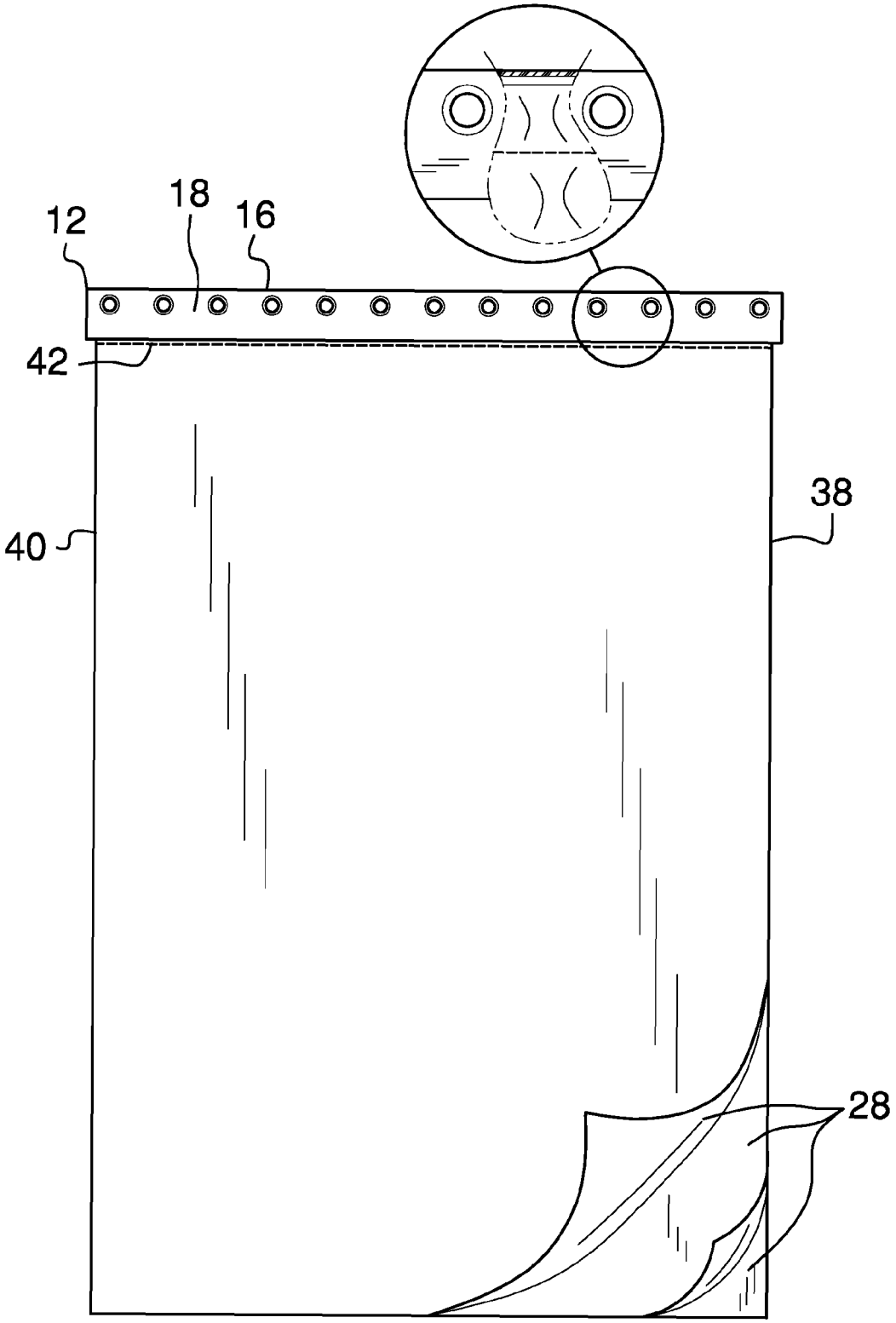
FIG. 3 is a back view of an embodiment of the disclosure.
Figure 4:
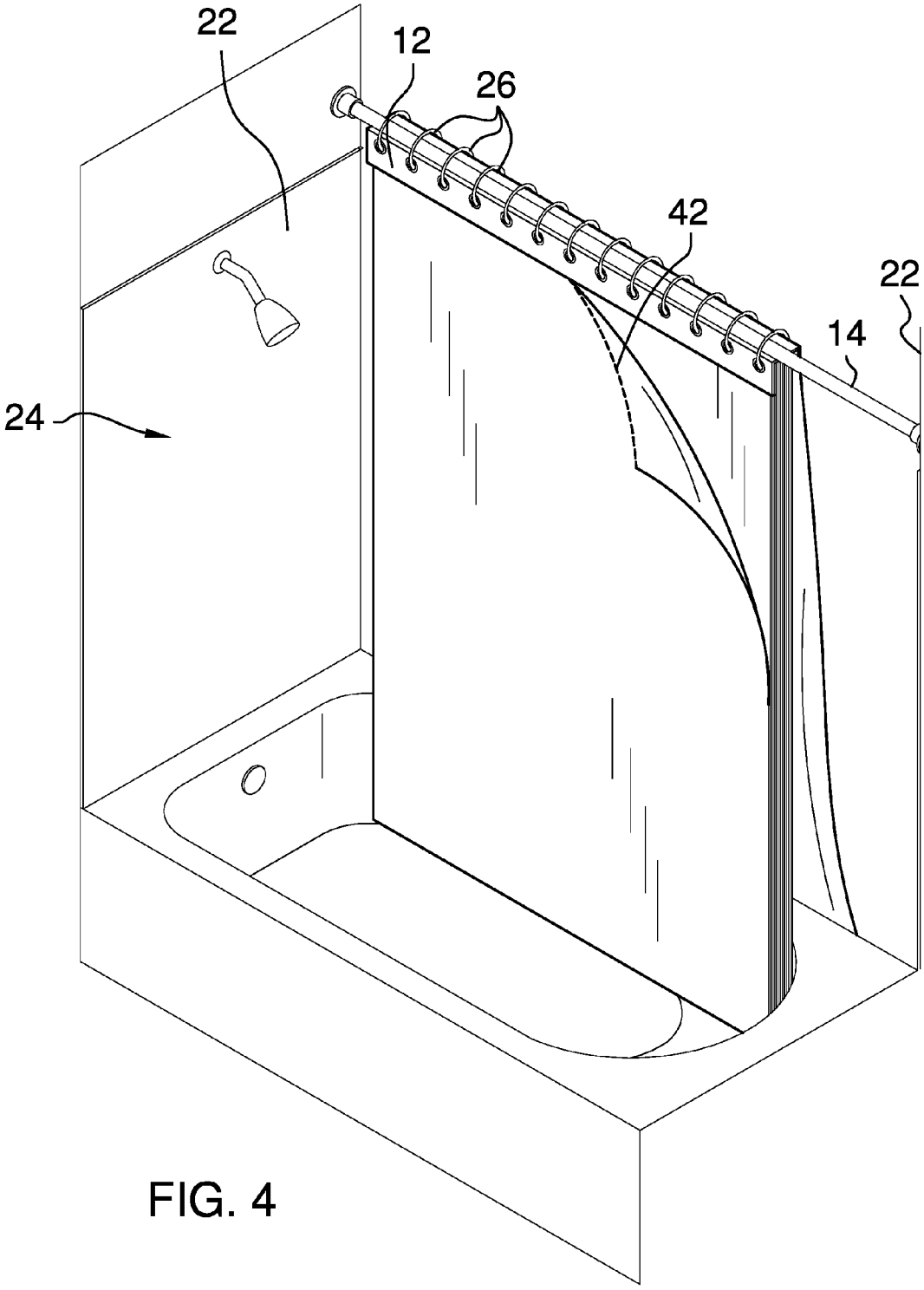
FIG. 4 is a perspective in-use view of an embodiment of the disclosure.

With reference now to the drawings, and in particular to FIGS. 1 through 4 thereof, a new curtain device embodying the principles and concepts of an embodiment of the disclosure and generally designated by the reference numeral 10 will be described.

As best illustrated in FIGS. 1 through 4, the shower curtain assembly 10 generally comprises a saddle 12 that may be suspended from a shower rod 14. The saddle 12 has a central panel 16 extending between a pair of outer panels 18. The outer panels 18 are spaced apart from each other to define a space 20 between the outer panels 18. The shower rod 14 extends between a pair of walls 22 of a shower 24. The shower 24 may be a bathing shower of any conventional design.

A plurality of rings 26 is provided and each of the rings 26 extends through each of the outer panels 18. The rings 26 are spaced from the central panel 16. Moreover, the rings 26 are spaced apart from each other and are distributed along the saddle 12. Each of the rings 26 may have the shower rod 14 extending therethrough. Thus, the saddle 12 may be suspended from the shower rod 14.

A plurality of curtains 28 is provided and each of the curtains 28 is removably coupled to the saddle 12. Thus, each of the curtains 28 may inhibit water from spraying outwardly from the shower 24. Each of the curtains 28 is selectively removed from the saddle 12 when each of the curtains 28 becomes soiled. Thus, the plurality of curtains 28 enhances cleanliness of the shower 24.

The plurality of curtains 28 includes an outermost curtain 30. The outermost curtain 30 has an exposed surface 32 and indicia 34 are printed on the exposed surface. The indicia 34 may comprise geometric shapes or other ornamental imagery. The plurality of curtains 28 is positioned such that the outermost curtain 30 faces outwardly from the shower 24. Each of the plurality of curtains 28 is comprised of a fluid impermeable material.

Each of the curtains 28 has an upper edge 36, a first lateral edge 38 and a second lateral edge 40. Each of the curtains 28 has a perforation 42 such that each of the curtains 42 is selectively removable from the saddle 12. The perforation 42 corresponding to each of the curtains 28 extends between the first lateral edge 28 and the second lateral edge 38. Moreover, the perforation 42 corresponding to each of the curtains 28 is spaced from the upper edge 36 of the corresponding curtain 28. Each of the curtains 28 is positioned in the space 20 in the saddle 12 and the curtains 28 are distributed between the outer panels 18. Each of the rings 26 extends through each of the curtains.

In use, the shower rod 14 is extended through each of the rings 26. The shower rod 14 is positioned to extend between the walls 22 of the shower 24. Moreover, the curtains 28 are oriented such that the outermost curtain 30 faces outwardly from the shower 24. Each of the curtains 28 is selectively torn along the perforation 42 when each of the curtains 28 becomes soiled. Thus, a clean curtain is readily available for use in the shower 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A shower curtain assembly having a plurality of removable liners, said assembly comprising:

a saddle being configured to be suspended from a shower rod, wherein said saddle has a central panel extending between a pair of outer panels, said outer panels being spaced apart from each other to define a space between said outer panels;

a plurality of curtains, each of said curtains being removably coupled to said saddle wherein each of said curtains is configured to inhibit water from spraying outwardly from the shower, each of said curtains being selectively removed from said saddle when each of said curtains becomes soiled wherein said plurality of curtains is configured to enhance cleanliness of the shower; and a plurality of rings, said rings being spaced apart from each other and being distributed along said saddle, each of said rings extending through each of said outer panels and each of said curtains wherein said rings are configured for suspending said saddle and said curtains from the shower rod when the shower rod is extended through said rings.

2. The assembly according to claim 1, further comprising each of said rings being spaced from said central panel.

3. The assembly according to claim 1, wherein each of said curtains has an upper edge, a first lateral edge and a second lateral edge, each of said curtains having a perforation such that each of said curtains is selectively removable from said saddle, said perforation corresponding to each of said curtains extending between said first lateral edge and said second lateral edge, said perforation corresponding to each of said curtains being spaced from said upper edge of said corresponding curtain.

4. A shower curtain assembly having a plurality of removable liners, said assembly comprising:

a saddle being configured to be suspended from a shower rod, said saddle having a central panel extending between a pair of outer panels, said outer panels being spaced apart from each other to define a space between said outer panels;

a plurality of rings, each of said rings extending through each of said outer panels having each of said rings being spaced from said central panel, said rings being spaced apart from each other and being distributed along said saddle, each of said rings being configured to have the shower rod extending therethrough thereby facilitating said saddle to be suspended from the shower rod; and a plurality of curtains, each of said curtains being removably coupled to said saddle wherein each of said curtains is configured to inhibit water from spraying outwardly from the shower, each of said curtains being selectively removed from said saddle when each of said curtains becomes soiled wherein said plurality of curtains is configured to enhance cleanliness of the shower, each of said curtains having an upper edge, a first lateral edge and a second lateral edge, each of said curtains having a perforation such that each of said curtains is selectively removable from said saddle, said perforation corresponding to each of said curtains extending between said first lateral edge and said second lateral edge, said perforation corresponding to each of said curtains being spaced from said upper edge of said corresponding curtain, each of said curtains being positioned in said space in said saddle, said curtains being distributed between said outer panels, each of said rings extending through each of said curtains.

* * * * *